US010925391B1

(12) United States Patent
Stilley

(10) Patent No.: US 10,925,391 B1
(45) Date of Patent: Feb. 23, 2021

(54) HINGED SHELF CONTAINER

(71) Applicant: Russell L. Stilley, Conroe, TX (US)

(72) Inventor: Russell L. Stilley, Conroe, TX (US)

( * ) Notice: Subject to any disclaimer, the term of this patent is extended or adjusted under 35 U.S.C. 154(b) by 0 days.

(21) Appl. No.: 16/299,010

(22) Filed: Mar. 11, 2019

Related U.S. Application Data

(60) Provisional application No. 62/641,714, filed on Mar. 12, 2018.

(51) Int. Cl.

| | |
|---|---|
| ***A47B 46/00*** | (2006.01) |
| ***A47B 51/00*** | (2006.01) |
| ***A47B 43/00*** | (2006.01) |
| ***B65D 21/08*** | (2006.01) |

(52) U.S. Cl.
CPC ..... *A47B 51/00* (2013.01); *A47B 43/00* (2013.01); *A47B 46/005* (2013.01); *B65D 21/086* (2013.01)

(58) Field of Classification Search
CPC ..... A47B 46/005; A47B 46/00; A47B 77/00; A47B 77/10; A47B 43/00; A47B 43/003; A47B 51/00
See application file for complete search history.

(56) References Cited

U.S. PATENT DOCUMENTS 1,015,722 A 1/1912 Bezold
2,875,903 A * 3/1959 Shourds ..... A47B 61/02 211/100
2,998,886 A * 9/1961 Sides ..... A47F 5/01 211/133.5
3,088,422 A * 5/1963 Kaeslin ..... A47G 25/02 108/29
3,311,438 A 3/1967 Barrow
3,406,999 A * 10/1968 Kozicki ..... B60P 3/36 296/156
3,449,799 A * 6/1969 Bien ..... F16B 37/043 411/548
3,586,410 A 6/1971 Barrow
3,589,524 A * 6/1971 Schramm ..... A47F 5/0037 211/39
4,006,826 A * 2/1977 Rich ..... A47F 5/0087 211/101
4,114,764 A * 9/1978 Rich ..... A47F 5/0087 211/100
4,125,078 A * 11/1978 Nyquist ..... A47B 61/00 108/29
4,361,099 A * 11/1982 Kokenge ..... F16B 5/123 108/108
4,534,601 A * 8/1985 Zwick ..... A47B 46/005 312/201
4,662,690 A 5/1987 Genereaux
4,725,108 A 2/1988 Wilson
5,226,714 A 7/1993 Wright
(Continued)

*Primary Examiner* — Kimberley S Wright
(74) *Attorney, Agent, or Firm* — Roger N. Chauza, PC

(57) ABSTRACT

A storage system that allows a user to store items higher above a shelf than can otherwise be easily reached. A container is pivotally attached to two arms of a U-shaped support rod. The cross bar portion of the U-shaped support rod is pivotally attached to the frontal portion of the shelf. With this arrangement, the user can swing the container in a arc from a lower position convenient to the user, to an upper position overlying the shelf. The cross bar can be attached to either a wire-type shelf or a wood shelf using brackets that need no threaded fasteners.

19 Claims, 12 Drawing Sheets

(56) References Cited

U.S. PATENT DOCUMENTS 5,346,077 A * 9/1994 Randall ..... A47B 75/00 211/134
5,385,399 A 1/1995 Weidner
5,499,584 A 3/1996 Taylor
5,560,501 A * 10/1996 Rupert ..... A47B 46/00 211/104
5,597,077 A * 1/1997 Hartmann ..... A47F 5/0056 211/134
5,599,617 A * 2/1997 Ewald ..... A61L 15/425 428/317.3
5,931,551 A * 8/1999 Wang ..... A47B 61/00 312/245
6,039,422 A * 3/2000 Butters ..... A47B 45/00 16/422
6,105,795 A * 8/2000 Terragni ..... A47G 25/02 211/100
6,390,310 B1 * 5/2002 Insalaco ..... A47B 96/02 211/134
7,681,728 B2 * 3/2010 Sabounjian ..... A45C 7/0077 206/278.1
7,806,280 B1 * 10/2010 Perkins ..... A47G 25/0685 211/100
8,061,789 B2 * 11/2011 Krueger ..... A47B 61/00 211/100
8,157,108 B1 4/2012 Waldrop
8,820,003 B2 9/2014 DeLorean
9,277,814 B2 * 3/2016 Winker ..... A47B 87/005
9,326,604 B1 * 5/2016 Schuldt ..... A47B 96/04
9,510,675 B2 12/2016 Baranski
10,098,460 B1 * 10/2018 Brinton, Jr. ..... A47B 96/145
2004/0027037 A1 * 2/2004 Krueger ..... A47B 46/005 312/248
2007/0023374 A1 * 2/2007 Nawrocki ..... A47F 5/0846 211/90.01
2009/0139943 A1 * 6/2009 Fernandez ..... A47B 45/00 211/94.01
2010/0140194 A1 * 6/2010 Krueger ..... A47B 46/005 211/1.57
2011/0290796 A1 * 12/2011 Burgess ..... B65D 21/04 220/23.2
2012/0085759 A1 * 4/2012 Sabounjian ..... A47B 43/003 220/9.2
2014/0111073 A1 4/2014 Kunis
2015/0254603 A1 * 9/2015 Bashkin ..... G06Q 10/087 312/237
2018/0091782 A1 * 3/2018 Bashkin ..... H04N 7/188
2019/0059587 A1 * 2/2019 Brinton, Jr. ..... A47B 96/145
2019/0122167 A1 * 4/2019 Bashkin ..... G06Q 10/087

* cited by examiner

HINGED SHELF CONTAINER

This non-provisional patent application claims the benefit of provisional application Ser. No. 62/641,714 filed Mar. 12, 2018.

TECHNICAL FIELD OF THE INVENTION

The present invention relates in general to containers, and more particularly to methods and apparatus for moving a container in an arc with respect to a shelf, or the like.

BACKGROUND OF THE INVENTION

Most persons have many more clothing items than can be worn at a single time. As such, the storage of the clothing items is a necessity. Clothes, including inner and outer garments, are often stored in upright dressers or closets. Dressers have multiple drawers, each of which can be pulled outwardly by the user to search for the desired clothing item. Dressers are examples of storage fixtures that are constructed to easily access the items in each drawer. Closets are also useful for storing clothing items. Most closets have a horizontal bar for hanging clothing items therefrom. The clothes are generally hung on a wire hanger, the hook thereof which is employed to hang from the horizontal bar.

A common complaint of users of garment closets is that there is not sufficient room, and that the room that exists is not efficiently used or difficult to access. There are hanger devices that allow additional garments to be hung from the hanger rod that spans the closet. Many closets employ one or more shelves above the hanger rod, where the shelves can be used to store less often used clothing items, such as hats, blankets, seasonal clothes, etc. One reason such items are stored on the shelves is that the items are not often used, and are difficult to reach by a user without using a stool, chair or the like.

The advantage of having a storage area on a shelf above the horizontal hanger bar is that clothing items not often worn can be stored in such area without mixing the same with often-worn clothing items. However, it is generally more difficult to access the storage shelf in a closet, as a person often must use a stool or small ladder to stand on to reach the items on the closet storage shelf. Another disadvantage is that when storing boxes and the like on the closet storage shelf, it is difficult to determine the contents of the boxes, unless the containers are transparent.

The same problem exists with the storage of food items in pantries and the like. In order to maximize the storage of food items in pantries, shelves are often located higher than is convenient for a user. Light weight food items, such as extra cereal boxes, and other boxed items, can be temporarily stored on the higher shelves. When the food items are needed, the user often uses a stool to stand on to reach the items on the higher shelves.

It can be seen from the foregoing that a need exists for a storage system constructed for easily accessing containers stored on or above closet or pantry storage shelves, or other types of shelves. A further need exists for a storage system that is adapted for storing containers higher over a shelf than present storage shelves, but can still be easily accessed. Yet another need exists for a storage system that is easily constructed, not complicated, and is thus cost effective.

SUMMARY OF THE INVENTION

In accordance with the principles and concepts of the invention, there is disclosed a storage system that includes a support rod that hinges at one end thereof with respect to a shelf. At the other end, the support rod pivotally supports a container for storing items therein. The end of the support rod and thus the container can be moved in an arc by the user from an upper location overlying the shelf, to a lower location easily accessible by the user.

The storage system of the invention is compact for purposes of shipping, can be easily assembled by the user, and easily installed on the edge of a shelf. The container can be constructed with a transparent front so that items therein can be easily seen. The container can be swung to a location where the user can conveniently place items in the container or remove items therefrom, and then swing the container upwardly and out of the way over a shelf or the like.

According to a feature of the invention, the storage system can be easily assembled without any tools or additional hardware. The support rod is U-shaped and has ends equipped with plastic snaps that are pushed into grommets located on opposite sidewalls of the container. Plastic shelf brackets are easily attached to a wire-type shelf by snap-locking the same to the wires of the shelf. Lastly, the cross bar of the U-shaped support rod is snap locked to the plastic shelf brackets, thereby allowing the support arms and thus the container to be swung from a location convenient to the user, to a location above the shelf.

With regard to yet another feature of the invention, a different shelf bracket can be employed for fastening the U-shaped support rod to the front of a wooden shelf.

The container can be constructed with a transparent front sidewall so that when stowed above a shelf, the contents of the container can still be easily seen.

The length of the support arms can be elongated so that when the container is swung above the shelf, the bottom of the container is elevated above the shelf so that other items can be stored on the shelf, under the container.

A feature of the invention is that various types of containers can be utilized with the pivoting mechanisms to provide the proper type of storage to the user. The containers can be simply a box type of container, a box together with one or more drawers, a tray for holding a standard storage box, or other types of containers.

With regard to an embodiment of the invention, disclosed is a storage system for use with a shelf. The storage system includes a container for storing items therein, and a support rod having two ends. Each end of the support rod is pivotally connected to the container so that the container can rotate about its pivotal connection with the support rod ends. The support rod is constructed with a cross bar. The storage system further includes one or more shelf brackets that are attachable to a frontal part of the shelf. Each of the shelf brackets has a receptacle for receiving therein the support rod cross bar so that the cross bar can rotate within the receptacle of the one or more shelf brackets. With this arrangement, the container can swing from a stowed position above the shelf to a loading positon in front of and lower than the shelf.

With regard to another embodiment, disclosed is a storage system for use with a shelf that includes a container for storing items therein, where the container is constructed with a pair of opposite sidewalls, and each opposite sidewall has a grommet therein. A support rod having two arms is connected by a cross bar, and each arm terminates in an end. Further included is a snap connected to each end of the support rod. Each of the snaps includes a stud terminating in an enlarged end. The stud is adapted for rotating in a respective grommet and the enlarged ends of the stud prevent inadvertent removal of the snap from the respective grommet. One or more shelf brackets are attachable to a frontal part of the shelf, and each shelf bracket has a receptacle for receiving therein the support rod cross bar so that the cross bar can rotate within the receptacle of the one or more shelf brackets. Accordingly, the container can swing from a stowed position above the shelf to a loading positon in front of and at a lower elevation than the shelf.

According to yet another embodiment, disclosed is a storage system for use with a shelf, where the storage system includes a container constructed so as to be unfolded from a flat structure to a cube structure with four sidewalls. The container includes a bottom panel forming a bottom of the container, and the container has a top that overlies the bottom panel when the container is in an upright position. A U-shaped support rod has a lateral cross bar at one end thereof and two arms that each terminate in an end. Each support rod end is pivotally attachable to a respective sidewall of the container, whereby when the U-shaped support rod is pivoted about the lateral cross bar, the container swings about an arc but remains upright. The lateral cross bar of the U-shaped support rod is pivotally attached to a frontal portion of the shelf so that the U-shaped support rod swings in an arc about its pivotal attachment location at the frontal portion of the shelf, whereby the container also moves in an arc about the pivotal attachment of the lateral cross bar to the shelf. Accordingly, the container can be moved by a user from a stowed location above the shelf to a loading location that is lower in elevation than the shelf.

BRIEF DESCRIPTION OF THE DRAWINGS

Further features and advantages will become apparent from the following and more particular description of the preferred and other embodiments of the invention, as illustrated in the accompanying drawings in which like reference numbers generally refer to the same parts, functions or elements throughout the views, and in which.

DETAILED DESCRIPTION OF THE INVENTION

When objects are stored on a high shelf, it can be difficult for a person to easily retrieve such items. The various features of the invention make possible the retrieval of items located high on a shelf, and for returning the items back on the shelf. According to an embodiment of the invention, the storage system comprises three main parts. One part is a flat folding container that expands out to a cube shape. Another part is a "U" shaped metal support rod that is snapped onto both sides of the container. The last part is one or more plastic clips that pivotally hold the metal support rod to either a wire shelf or a wooden shelf. With this arrangement, the container can be moved in an arc from a stowed location above the shelf, to a lower position convenient to the user. A handle located on the lower front side of the container allows a user to reach up to slightly above the height of the shelf to swing the container down in front of the user. Simply pulling on the container handle rotates the metal support rod that is pivotally attached to the shelf with the plastic clips. The metal support rod prevents the container from twisting as it is being pulled down or pushed up onto the shelf. The container rotates down to a level below the shelf to allow easy access to the contents of the container. Once items are placed in or removed from the container, the container is then easily rotated via the metal support rod back up onto the shelf. The user never has to reach much higher than the self itself to retrieve anything stacked higher on the shelf.

Figure 1:
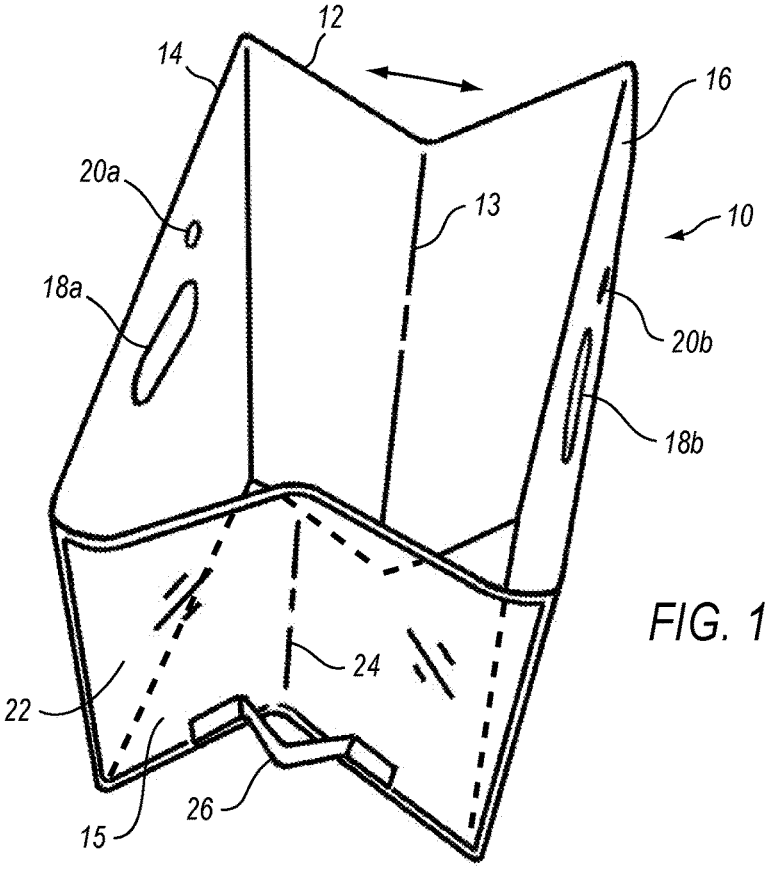
FIG. 1 is a perspective view of the container that is expandable from a flat structure to a cube shape.

With reference to the drawings, there is illustrated in FIG. 1 a collapsible container 10 employed with a dual hinged support rod, described below. The opposite sidewalls 14 and 16 and back foldable sidewall 12 of the container 10 can be fabricated using non-woven fabric outer layers with respective panels of chipboard sewn inside to provide three vertical rigid sidewalls. The non-woven fabric also forms an outer bottom 15 of the container 10. The back sidewall 12 is foldable along the fold line 13. A separate chipboard panel 28 covered with the non-woven fabric is insertable into the container 10 and rests on the bottom outer fabric. It is expected that the size of the container 10 according to a preferred embodiment is twelve inches by twelve inches in lateral dimensions, and about twelve inches high at the front and about sixteen inches high at the back. This amounts to about 1.2 cubic feet of storage space. Formed in each of the opposite sidewalls 14 and 16 of the container 10 is a respective oval hole 18*a* and 18*b*. Each oval hole 18*a* and 18*b* can be used as a handle. Formed near the top edge of each of the opposite sidewalls 14 and 16 is a respective grommet 20*a* and 20*b*. A hole can be formed in the sidewall at the grommet location, and a metal, rubber or plastic grommet inserted therein. As will be described below, the grommets 20*a* and 20*b* each receive therein an end of a hinging or pivoting mechanism. The front foldable sidewall 22 of container 10 is constructed using a clear vinyl material so that one can see the contents stored inside the container 10. The front sidewall 22 is foldable along the fold line 24. Attached to the front of the sidewall 22 by an adhesive or other suitable bonding agent, and at the bottom thereof is handle 26 that allows the user to pull the container 10 off a shelf. The handle 26 can be folded with the front sidewall 22. Materials other than those noted above can be utilized for constructing the container 10.

Figure 2:
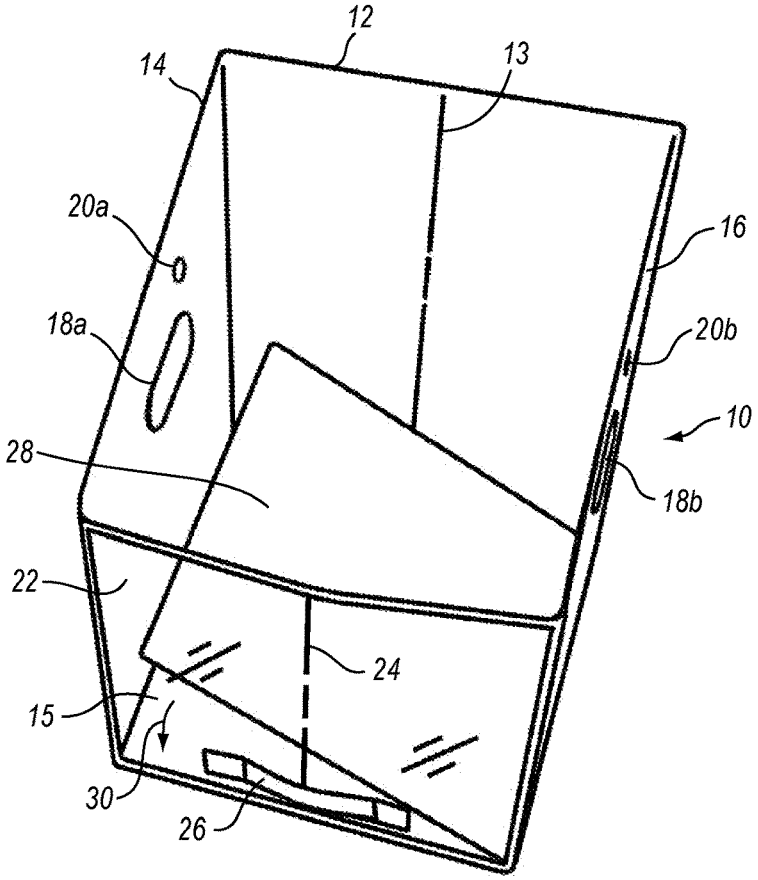
FIG. 2 is a perspective view showing the insertion of the bottom flat panel in the container.

As illustrated in FIG. 2, when the sidewalls of the container 10 are expanded along the back and frontal fold lines 13 and 24, a rigid bottom panel 28 can be inserted therein and moved to the bottom of container 10 and function as a floor. The bottom panel 28 friction fits within the sidewalls and keeps the container 10 in its open condition. As noted above, the fabric covered chipboard bottom panel rests on the non-woven fabric 15 that spans the bottom of the container 10. The rigid bottom 28 could be formed as part of one of the opposite sidewalls 14 or 16, and attached to the bottom edge thereof with a fold line. The bottom panel 28 can be moved to the bottom of the container in the direction shown by arrow 30. It can be appreciated that the fold lines 13 and 24 of the respective back and frontal sidewalls 12 and 22 allow the container 10 to be collapsed and made compact for shipping. Those skilled in the art may prefer to provide a rigid, non-collapsible box-like container made of other materials other than described above, with or without the transparent frontal sidewall. The container 10 can also be constructed entirely of a transparent plastic material. Moreover, while not shown, the container 10 can be equipped with a lid or other suitable cover.

Figure 3:
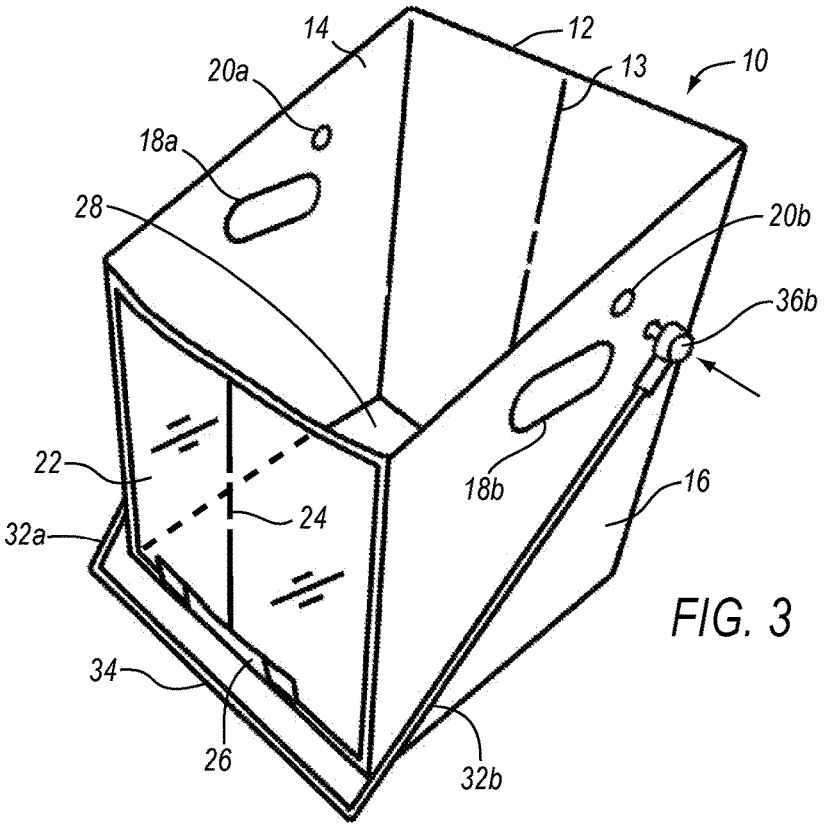
FIG. 3 is a perspective view showing how the plastic end pieces of the metal support rod are snapped into the side grommets of the container.

With reference now to FIG. 3 of the drawings, there is illustrated a hingeable support rod comprising a first arm 32*a* and a second arm 32*b*. The support arms 32*a* and 32*b* are connected at the ends by a cross bar 34 to form a U-shaped support rod. In practice, the support arms 32*a* and 32*b*, as well as the cross bar 34, are constructed with a single piece of a metal rod and bent into the U shape. The metal rod is generally rigid to prevent torsional movement between the ends. Attached to the free ends of the support arms 32*a* and 32*b* are respective plastic snaps 36*a* and 36*b*, shown in detail in FIGS. 4 and 5. The plastic snaps 36*a* and 36*b* are pushed into the respective grommets 20*a* and 20*b* formed in both sidewalls 14 and 16 of container 10. As used herein, a grommet is an eyelet of material to strengthen a hole in the sidewall of the container 10. The grommets 20*a* and 20*b* are located in the upper half of the respective opposite sidewalls 14 and 16 so that the container 10 remains upright when supported by the support rod. Preferably, the grommets 20*a* and 20*b* are located somewhat midway between the front edge and back edge of the sidewalls 14 and 16. When the cross bar 34 is hinged to a shelf, or the like, the support arms 32*a* and 32*b* allow the container 10 to be swung or rotated in an arc about the cross bar 34 part of the metal rod.

Figure 4:
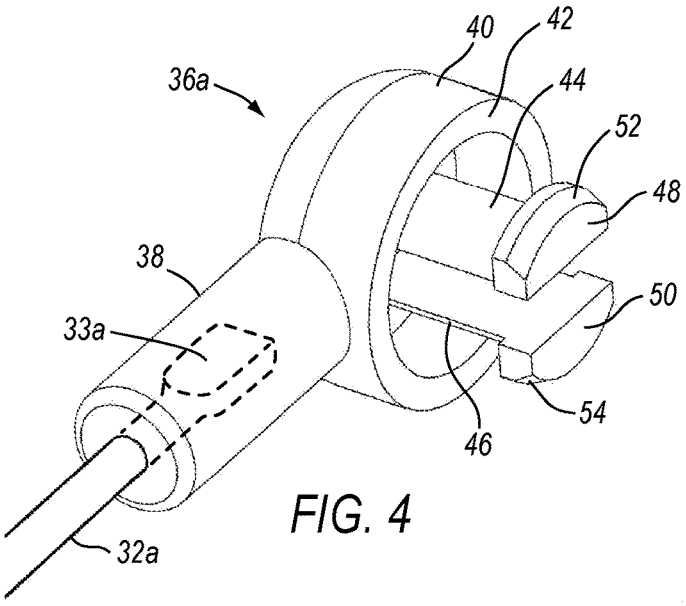
FIG. 4 is an enlarged perspective view of the plastic snap pieces formed at the end of each metal support rod.
Figure 5:
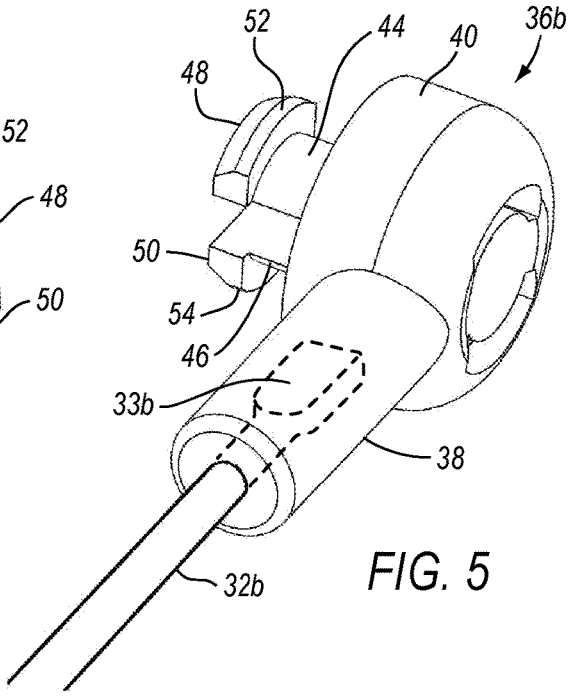
FIG. 5 is an enlarged perspective view of the outside of the plastic snap piece of FIG. 4.

As noted above, the details of the plastic snaps 36*a* and 36*b* are shown in respective FIGS. 4 and 5. Each plastic snap 36*a* and 36*b* is suitably bonded to the respective free end of the support arms 32*a* and 32*b*. In practice, the ends of the respective metal support arms 32*a* and 32*b* are formed with swaged metal ends 33*a* and 33*b* to assure that the support arms 32*a* and 32*b* cannot rotate within the respective plastic snaps 36*a* and 36*b*. With regard to the plastic snap 36*a* of FIG. 4, there is included a barrel-shaped base 38 that is molded around the end of the support arm 32*a*. As an alternative, the base 38 could be threaded internally for receiving therein a threaded end of the respective support arm 32*a* or 32*b*. A lock nut can be used to fix the position of the snap onto the threaded end of the support arm. This latter arrangement allows the user to effective lengthen or shorten the support arms 32*a* and 32*b* to assure that the container 10 lies on the top surface of the shelf.

Formed as part of the base 38 is cap-shaped end 40 having an annular edge 42. Formed in the cap 40 are two spaced-apart studs 44 and 46, each of which extend orthogonal outwardly with respect to the base 38. Cross-sectionally, each of the studs 44 and 46 is semicircular shaped, where the flat portions of each stud 44 and 46 are spaced from each other. Formed at the outer ends of each of the studs 44 and 46 is a respective enlarged end 48 and 50. The enlarged ends 48 and 50 are each formed with a tapered edge 52 and 54 to facilitate insertion of the studs 44 and 46 into the grommet 20*a*. During insertion of the studs 44 and 46 into the grommet 20*a*, the studs 44 and 46 are compressed toward each other, and then spring apart when fully inserted. The enlarged ends 48 and 50 prevent the studs 44 and 46 from being easily removed from the grommet 20*a*. As can be appreciated, the studs 44 and 46 rotate within the grommet 20*a* during pivoting of the support rods 32*a* and 32*b*. The plastic snap 36*b* of FIG. 5 is constructed in an identical manner as the plastic snap 36*a* of FIG. 4. While in one embodiment, the studs 44 and 46 are molded so as to be spaced apart for purposes of compression, a single stud could be employed with an enlarged end. Such an arrangement could be used where the grommet 20*b* is flexible, such as a rubber grommet. In other instances, the ends of each support arms could be bent at a right angle to extend through a respective grommet, and a push nut installed on the end of the support arm to form an enlargement to prevent removal of the support arm end from the grommet. Other arrangements are possible.

Figure 6:
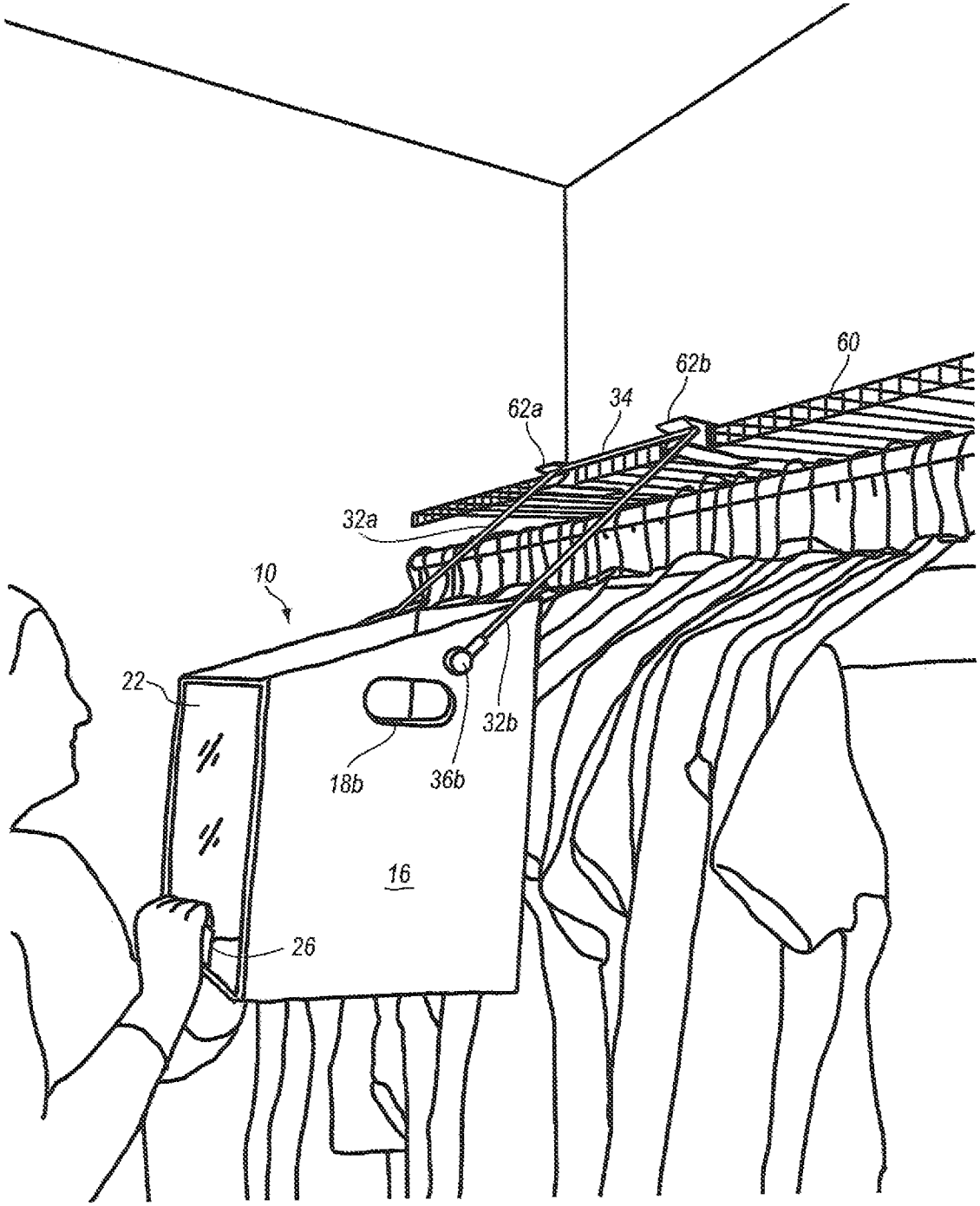
FIG. 6 is a perspective view showing the container pivot mechanism connected to a wire shelf, where the container is pivoted to its lowest point.

Referring now to FIG. 6, the container 10 is illustrated with the support rods 32*a* and 32*b* pivotally attached to the frontal edge of a conventional wire-type shelf 60. The cross bar 34 of the hingeable support rod is connected to the frontal edge of the wire shelf 60 using a pair of identically constructed plastic wire shelf brackets 62*a* and 62*b*. During installation, the wire shelf brackets 62*a* and 62*b* are constructed so as to be snapped onto the front edge of wire shelf 60. Then, the cross bar 34 part of the frame is snapped into both of the wire shelf brackets 62*a* and 62*b*. It can be appreciated that the shelf brackets 62*a* and 62*b* allow the cross bar 34 to rotate therein and at the same time allow the support arms 32*a* and 32*b* to pivot in an arc. The pivotal action of the support arms 32*a* and 32*b* allows the container 10 to be rotated in an arc from a position above the wire shelf 60, to a position outwardly and downwardly in proximity to the user, and vice versa. In other words, the container 10 can be moved from a stowed location above the wire shelf 60, to a lower location where the contents of the container 10 are easily accessible to the user. In moving the container 10, the user simply grasps the frontal handle 26 of the container 10 and pulls or pushes thereon. The lower location of the container 10 is adjacent the user so that items can be easily seen, placed into the container 10 or removed from the container 10. In practice, when the container 10 is in its lower location, the back sidewall panel thereof can rest against the clothing items hung on hangers from the hanger rod.

Figure 7:
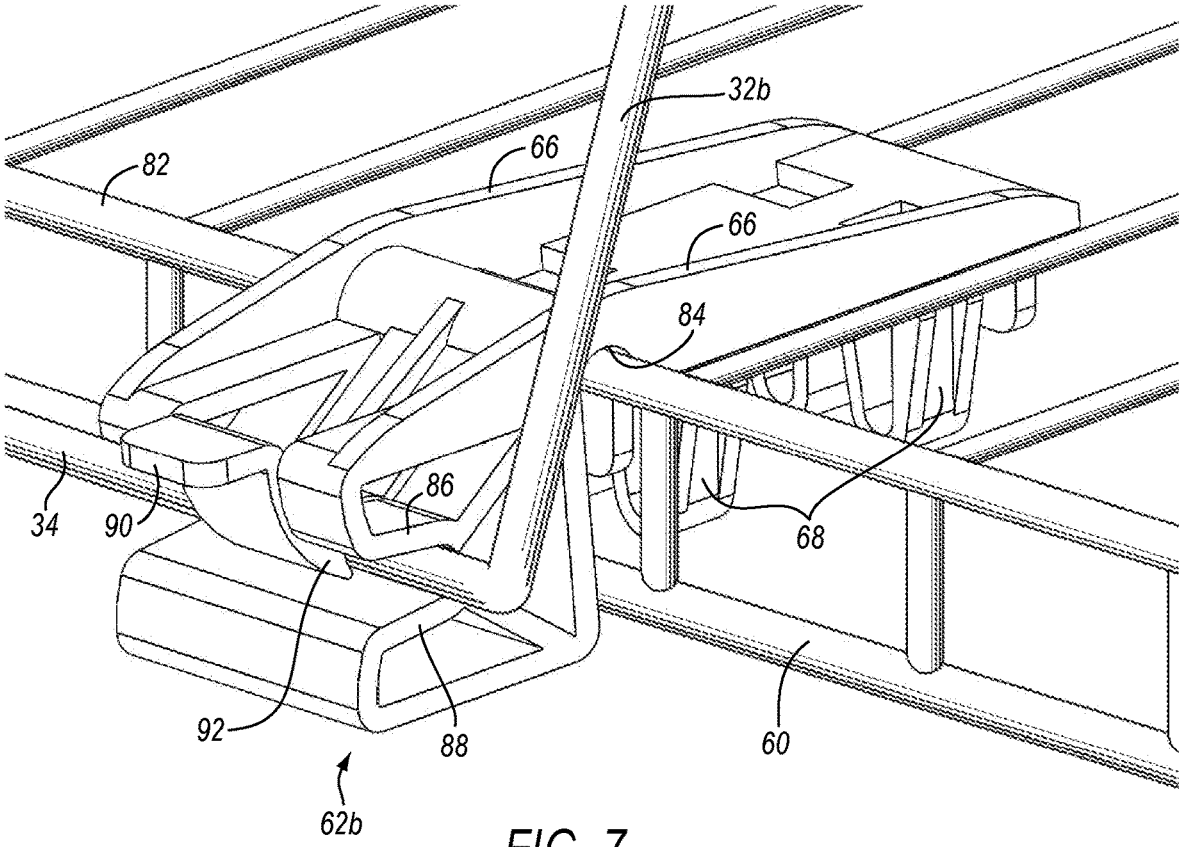
FIG. 7 is an enlarged perspective view showing one of the plastic brackets that holds the metal support rod to a wire shelf.
Figure 8:
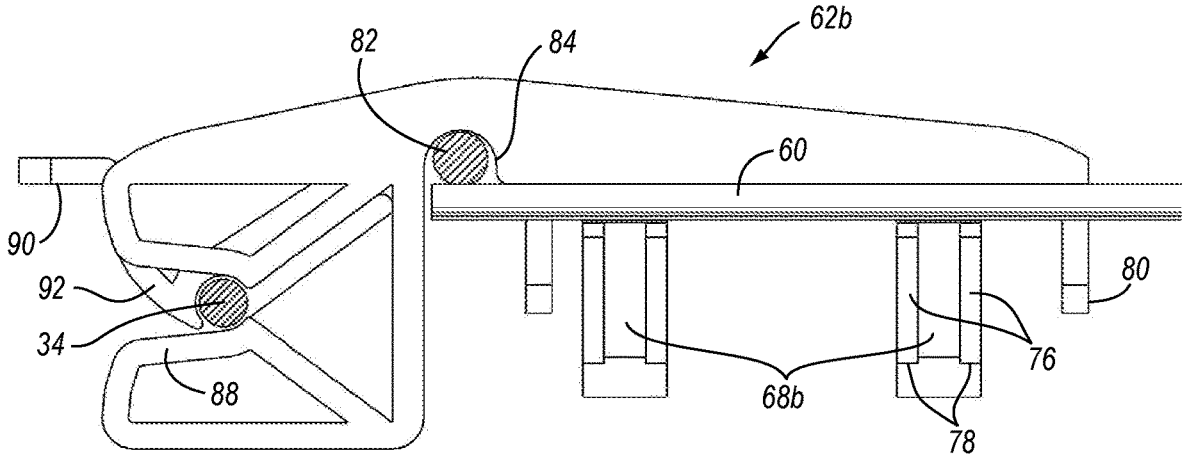
FIG. 8 is a side view of the plastic bracket of FIG. 7.
Figure 9:
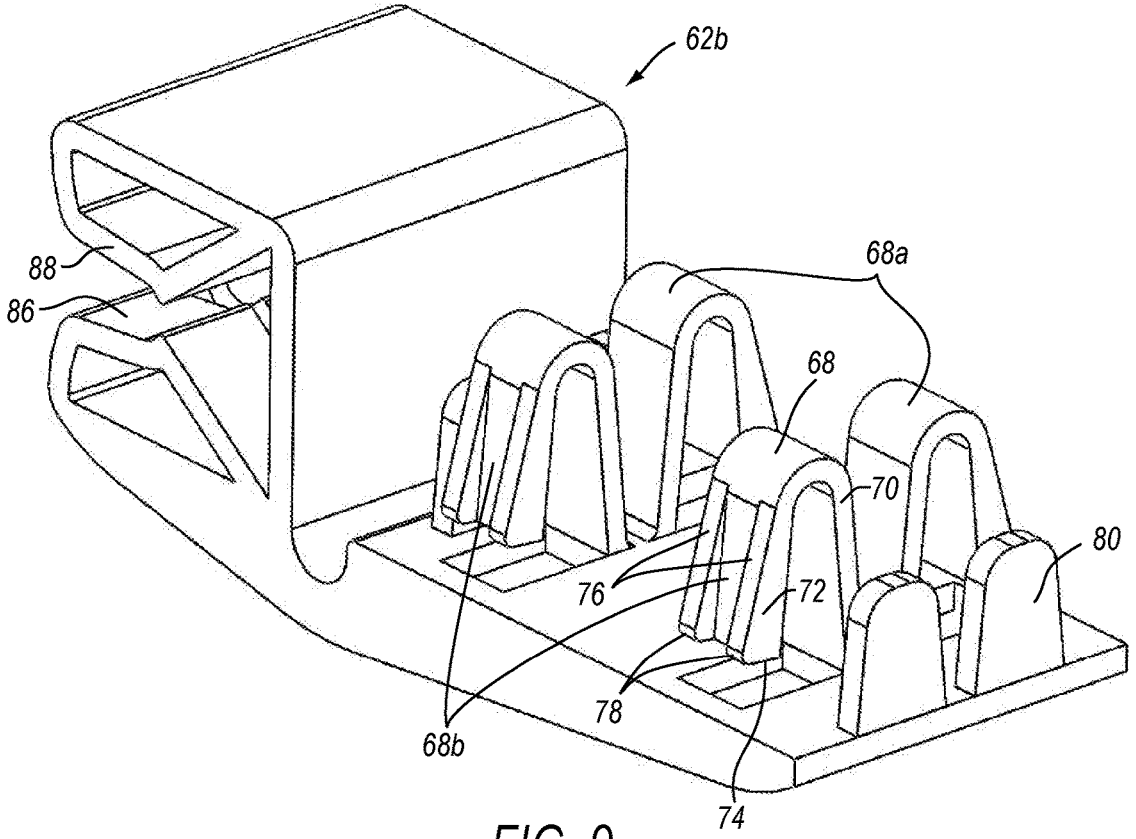
FIG. 9 is a perspective view of the plastic bracket of FIG. 7 turned upside down, thus showing the bottom thereof.

FIGS. 7-9 are enlarged views of one wire shelf bracket 62*b* which is snapped down and locked onto the wire shelf 60. The shelf bracket 62*b* is molded of plastic and includes a pair of top edges or rails 66 that have gradual curves to prevent the bottom container surfaces from catching thereon and interfering with the movement of the container 10 to the stowed position above the shelf 60. Formed on the bottom of the shelf bracket 62*b* are four downwardly depending snap-lock members 68. The first pair of snap-lock members 68*a* engages one wire of the wire shelf 60, and the second pair of snap-lock members 68*b* engage an adjacent wire of the wire shelf 60. The snap-lock members 68 are thus located between the two wires of the wire shelf 60. The four snap-lock members 68 are identically constructed and operate in the same manner. The snap-lock member 68 illustrated in FIG. 9 (shown upside down) is U-shaped with one arm 70 of the U molded integral with the plastic material of the shelf bracket 62*b*. The other arm 72 terminates in an end 74 that is not connected to the plastic material of the shelf bracket 62*b*. In this manner, the arm 72 of the snap-lock member 68 can flex when the shelf bracket 62*b* is pressed downwardly into engagement with one wire of the wire shelf 60. The arm 72 is formed with ramps 76 that engage the wire of the wire shelf 60 and urge the arm 72 inwardly when forced down onto the wire shelf 60. When the wire of the wire shelf 60 passes around the bottom corners 78 of the ramps 76, the arm 72 snaps back outwardly to its rest position, thus catching the wire under the bottom end 74. The snap-lock members 68*a* thus lock one wire of the wire shelf 60 thereto, and the other pair of snap-lock members 68*b* lock the adjacent wire thereto, thus locking the plastic shelf brackets 62*a* and 62*b* to the wire shelf 60. When it is desired to remove the shelf bracket 62*b* from the wire shelf 60, the user simply presses on the flexible arms 72 of the four U-shaped members so that the wires can move beyond the corners 78 and be free from engagement. There are four tabs, one shown as numeral 80, that provide respective stops so that the wire is captured against such stops 80 when locked within the snap-lock members 68. The other shelf bracket 62*a* functions in an identical manner. It can be appreciated that the shelf brackets 62*a* and 62*b* are constructed so that the user can easily snap lock the brackets 62 to the wire shelf without any tools, hardware or associated equipment. If desired, the shelf brackets 62*a* and 62*b* can be easily disengaged from the wire shelf 60 and moved to another location on the shelf 60.

It can be seen that the snap-lock function of the shelf brackets 62*a* and 62*b* make installation very easy, the brackets 62*a* and 62*b* as illustrated are not necessary to the operation of the hinged shelf container 10. The support arms 32*a* and 32*b* can be anchored to the wire shelf 60 in many other ways. For example, a plastic shelf bracket can be molded so that an upper part thereof overlies the wires of the shelf 60, and a separate bottom part is screwed upwardly to the upper plastic part to thereby capture the wires of the wire shelf 60 therebetween. Many other arrangements are possible.

As illustrated in FIG. 8, the plastic shelf bracket 62*b* is snap-locked to the wire shelf 60, and is prevented from forward or backward movement with respect to the shelf 60 by capturing the frontal, top shelf wire 82 within a lateral notch or tunnel 84 formed within the plastic shelf bracket 62*b*. The shape of the plastic shelf brackets can be altered during the molding process to accommodate many other types and styles of wire shelves. The shelf brackets 62*a* and 62*b* are constructed so that they fit onto five of the most popular types of wire shelves.

With reference yet to FIGS. 7 and 8, there is illustrated the manner in which one lateral end of the cross bar 34 is snap-locked to the frontal part of the plastic shelf bracket 62*b*. The other lateral end of the cross bar 34 is snap-locked to the other plastic shelf bracket 62*a* in an identical manner. The frontal portion of the plastic shelf bracket 62*b* extends beyond the front of the wire shelf 60 to allow the upper ends of the two support arms 32*a* and 32*b* to swing upwardly and over the wire shelf 60. The container 10, connected to the upper ends of the support arms 32*a* and 32*b*, can thus be swung upwardly and over the wire shelf 60.

The frontal portion of the shelf bracket 62*b* is molded with a pair of upper members 86 and a single lower member 88. The upper members 86 and the lower member 88 form somewhat of a V-shaped receptacle into which the cross bar 34 is pressed. A thumb-operated catch/release member 90 has an inner end molded integral with the plastic material of the shelf bracket 62*b*, but the free end of the thumb-operated catch/release member 90 can flex. After snap-locking the shelf bracket 62*b* onto the wire shelf 60 during installation, the metal cross bar 34 is pushed forwardly into the V-shaped receptacle formed by the members 86 and 88, which action raises the catch part 92 of the catch/release member 90. After the cross bar 34 passes beyond the catch part 92, the catch part 92 back moves to its relaxed condition to capture the cross bar 34. This is illustrated in FIG. 8. When it is desired to remove the cross bar 34 from its snap-lock engagement with the shelf bracket 62*b*, the thumb-operated part 90 can be manually raised with the user's thumb to allow removal of the cross bar 34 from the shelf bracket 62*b*. Again, no tools or equipment are necessary in order to install or remove the cross bar 34 from engagement with the plastic shelf bracket 62*b*. The other shelf bracket 62*a* operates in an identical manner.

Figure 10:
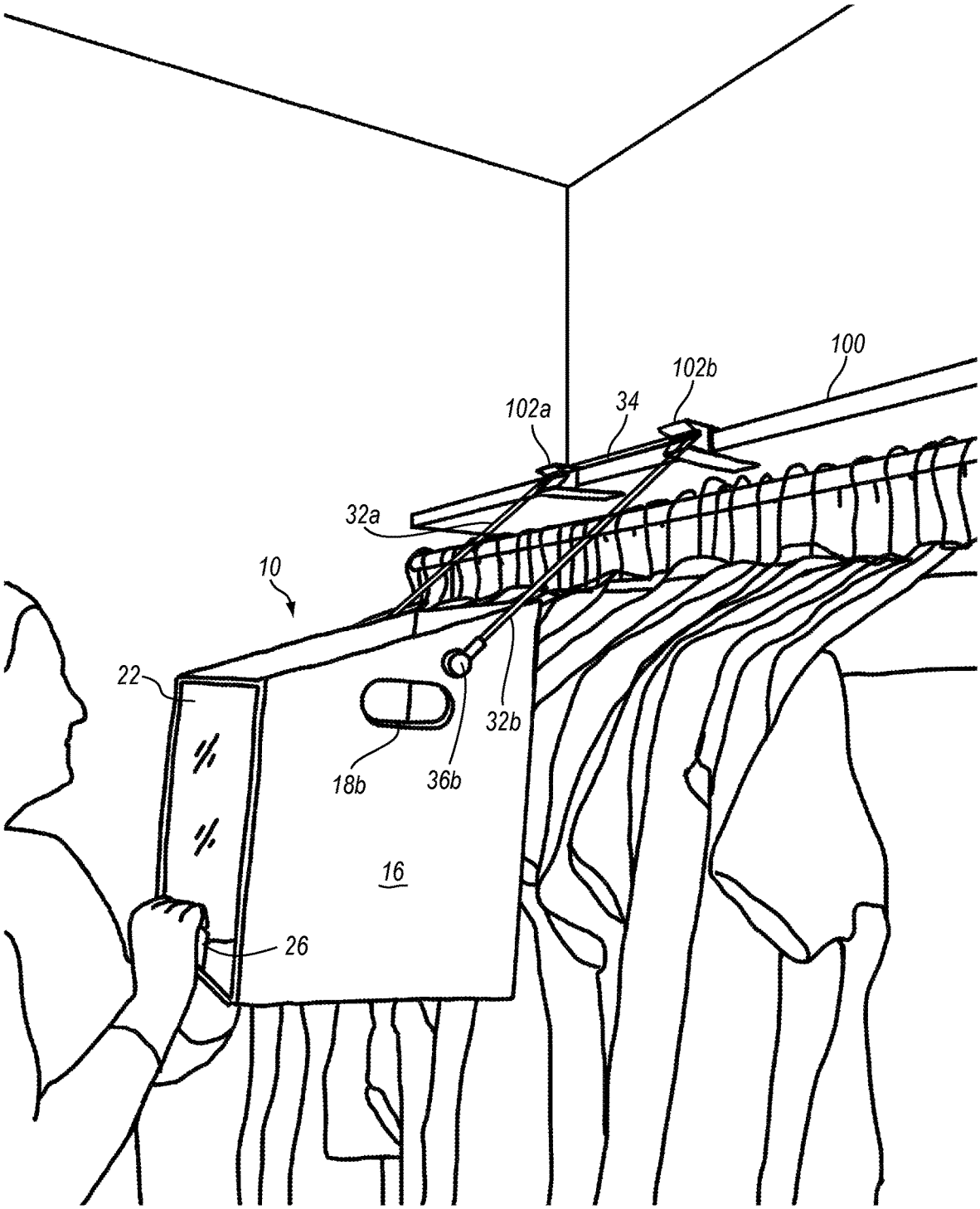
FIG. 10 is a perspective view showing the container connected to a wooden shelf, where the container is pivoted to its lowest point.
Figure 11:
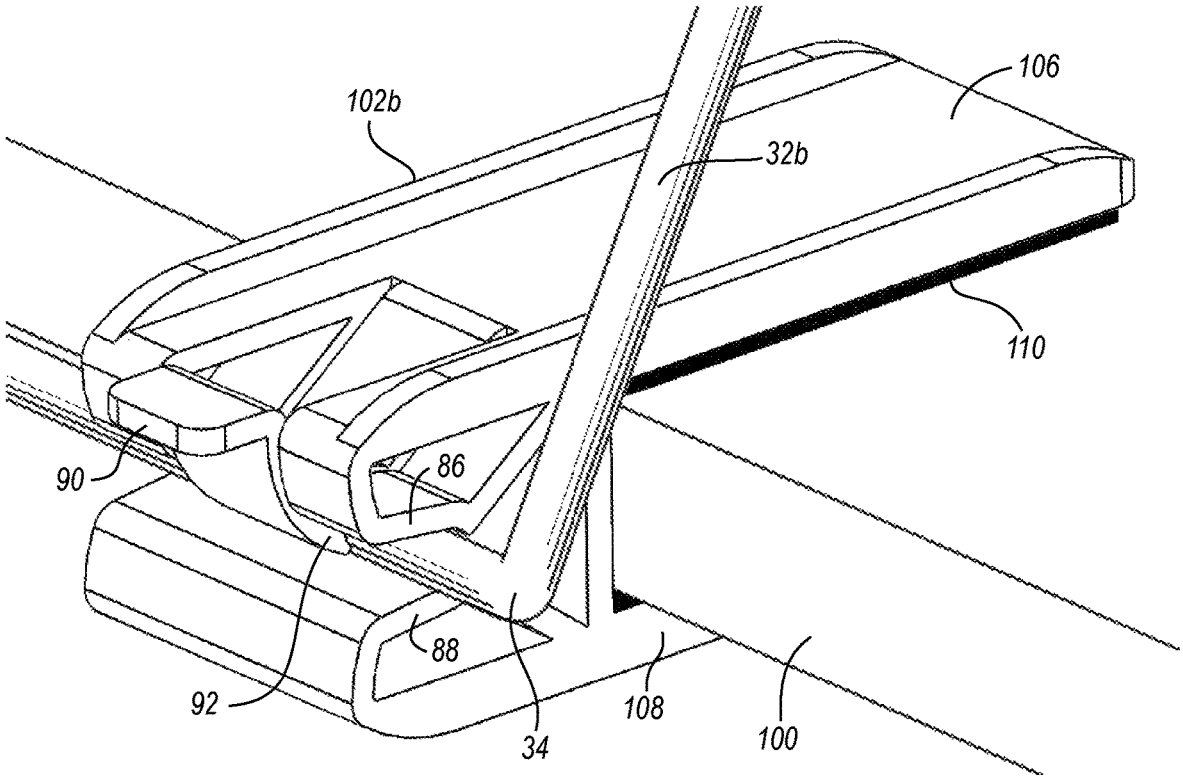
FIG. 11 is an enlarged perspective view showing one of the plastic brackets that holds the metal support rod to a wood shelf.
Figure 12:
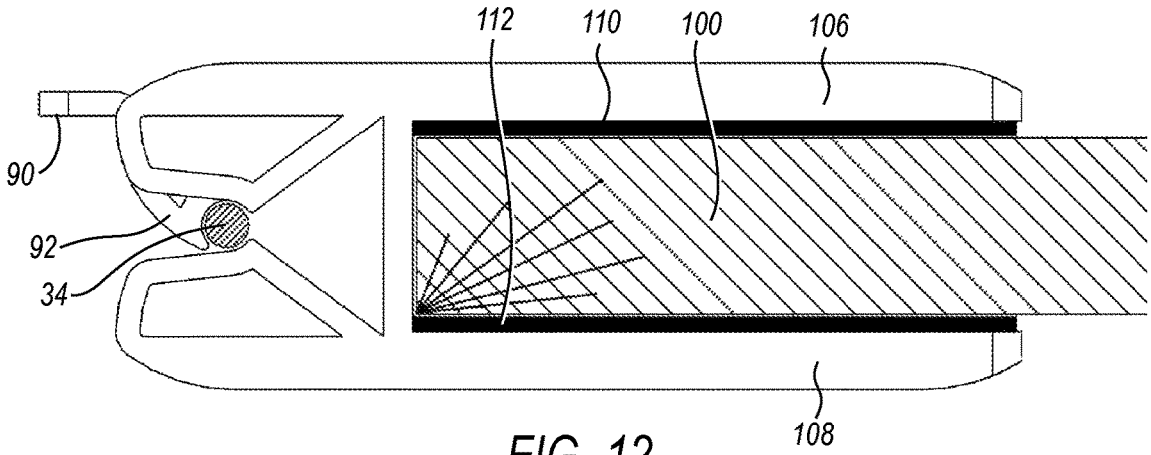
FIG. 12 is a side view of the plastic bracket of FIG. 11.

Referring now to FIG. 10, there is illustrated the manner in which the container 10 can be pivotally attached to a wooden shelf 100. The container 10 is constructed in the same manner described above, together with the two support arms 32*a* and 32*b* and associated cross bar 34. The cross bar 34 is pivotally attached to the wooden shelf 100 using two plastic shelf brackets 102*a* and 102*b*, shown in detail in FIGS. 11 and 12. The frontal portion of the wood shelf bracket 102*b* is constructed in an identical manner to that set forth above, to capture the cross bar 34 therein, and will not be further described here. Rather than utilizing the snap-lock arrangement used with the wires of a wire shelf 60, the frontal portion of the wooden shelf bracket 102*b* is molded with a top clip part 106 and a bottom clip part 108. The top clip part 106 has a bottom planar surface, and the bottom clip part 108 has a top planar surface. By use of the term planar, it is meant that the inner surfaces of the members 106 and 108 have planar surfaces that engage the upper and lower surfaces of the wood shelf. Attached to the underside of the top clip part 106 is a friction pad 110. Similarly, attached to the top of the bottom clip part 108 is a friction pad 112. The friction pads 110 and 112 can be constructed of a rubber material, or other suitable material that increases the friction to reduce movement of the plastic shelf bracket 102*b* with respect to the wood shelf 100. The other shelf bracket 102*a* is constructed in an identical manner. The spacing between the upper friction pad 110 and the bottom friction pad 112 is the same spacing as the thickness of the wood shelf 100. Accordingly, the shelf brackets 102*a* and 102*b* can be fabricated with different spacings between the upper clip part 106 and the lower clip part 108 to accommodate different thickness wood shelves.

While the preferred embodiment for wood shelf brackets is illustrated, such arrangement is not a necessity to the structure or operation of the invention. Rather, those skilled in the art may prefer to dispense with the bottom clip part 108 of the shelf bracket 102*b*, and employ one or more screws to fasten the top clip part 106 to the top surface of the wood shelf 100.

Figure 13:
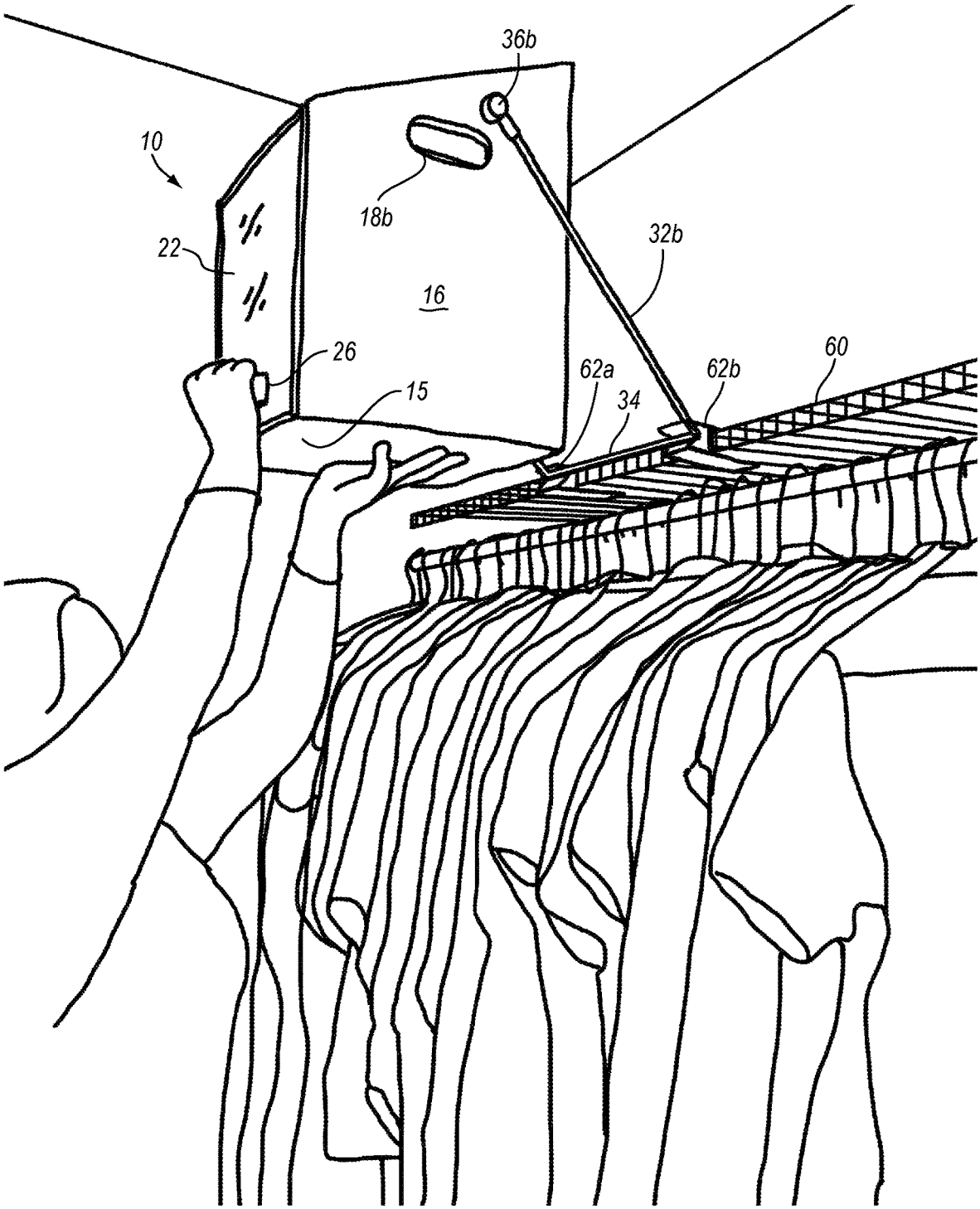
FIG. 13 is a perspective view showing the container rotated halfway between its stowed location resting on the shelf, and its lowermost location easily accessible by the user.
Figure 14:
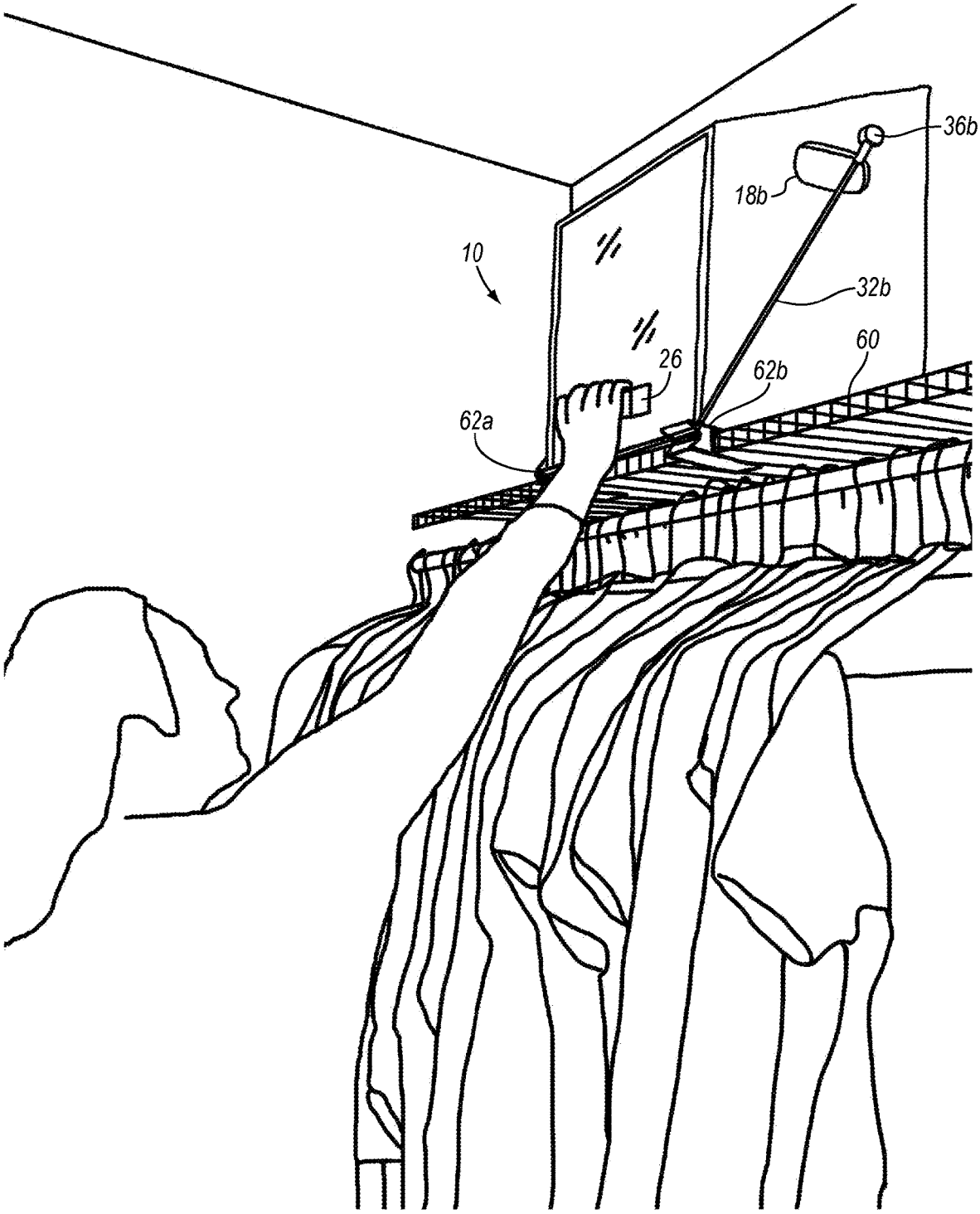
FIG. 14 is a perspective view showing the container of FIG. 13, rotated from the position in which it can be loaded with items, to a position where it rests on the shelf.

With reference to FIGS. 13 and 14 there is illustrated the manner in which the container 10 can be swung from an intermediate position (FIG. 13) of the arc to a stowed position (FIG. 14) in which the container 10 rests on the upper surface of the wire shelf 10. Depending on the length of the support arms 32*a* and 32*b*, the container 10 can remain in the stowed position with the container bottom panel 28 resting on the top surface of the wire shelf 60. Alternatively, the back sidewall 12 of the container 10 can engage the vertical surface of the closet wall. Indeed, the length of the support arms 32*a* and 32*b* can be lengthened so that when the container 10 is rotated to the stowed position, there is a substantial space between the bottom panel 28 of the container 10 and the top surface of the shelf. This space can be used by the user to store other boxes and clothing items that can be reached. With the container 10 overlying the stored boxes and clothing items, additional storage is available (in the container 10) that is ordinarily out of reach by the user.

In the event that the support arms 32*a* and 32*b* are elongated, the container 10 will be well above the shelf when in a stowed position. The handle 26 can be made of a sturdy material so that it can be grasped by an extension rod held by the user. The end of the extension rod can be equipped with a hook to reach the handle 26 when the container 10 high above the shelf and beyond the reach of the user.

Figure 15:
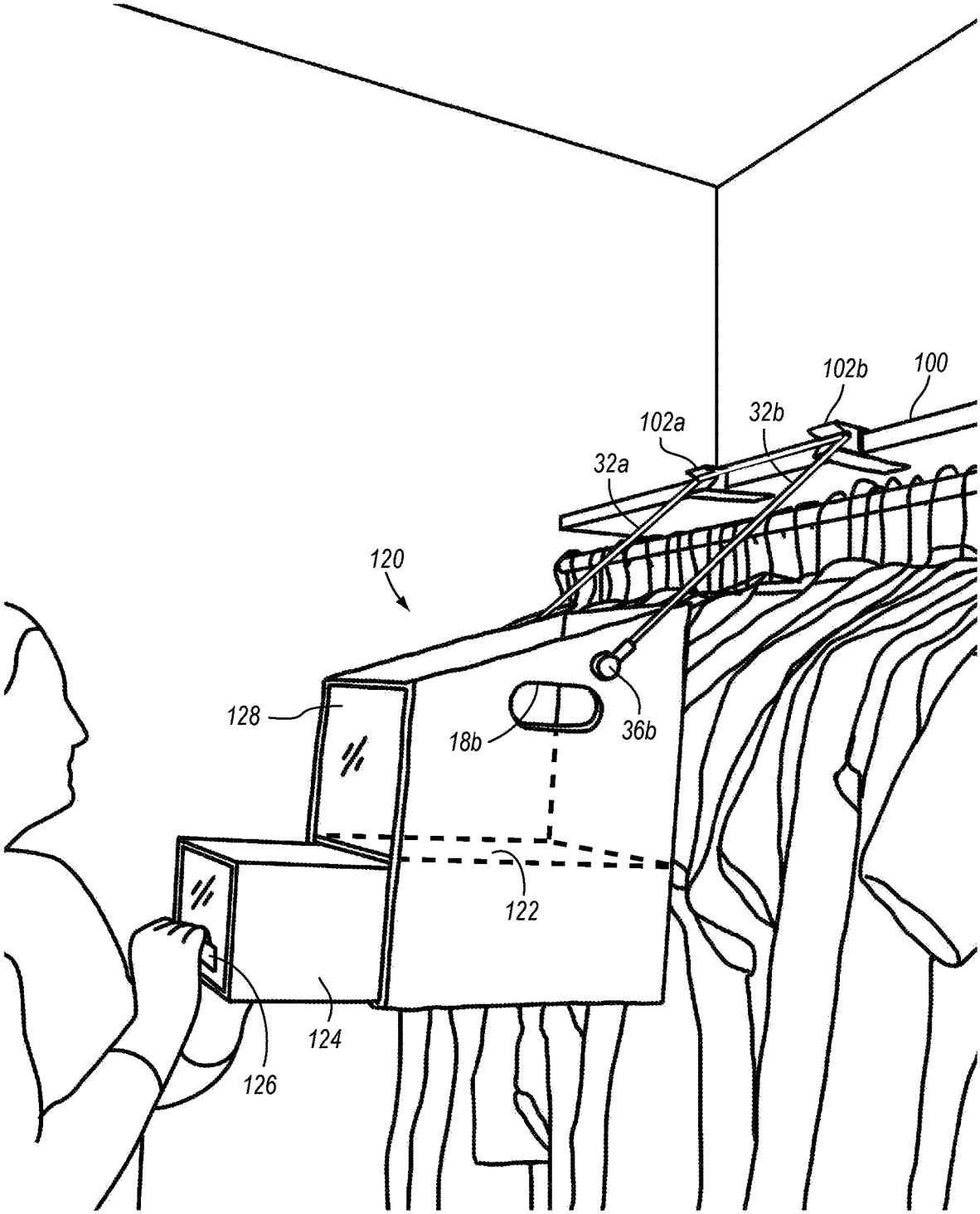
FIG. 15 is a perspective view of a pivotal container having a pull-type drawer integrated into the open-top container.

FIG. 15 illustrates a container 120 that can be rotated from a positon in which it can be loaded with items, to a stowed position located on or above the shelf 100. The shelf pivoting mechanism otherwise functions in the same manner described above. The container 120 includes an open top and an intermediate first bottom 122, as well as a second, lower bottom. There are thus two compartments, one above the intermediate first bottom 122, and a second lower compartment below the intermediate first bottom 122. The first upper compartment is much like that described in connection with the container 10 described above. The intermediate first bottom 122 forms the top of the second lower compartment. The second lower compartment is constructed to receive therein a drawer 124 equipped with a pull handle 126. While not shown, the container 120 can also have a pull-handle fastened to the frontal transparent sidewall 128 to facilitate pivotal movement of the container 120. In any event, the drawer 124 is constructed with an open top for placing smaller items therein.

Figure 16:
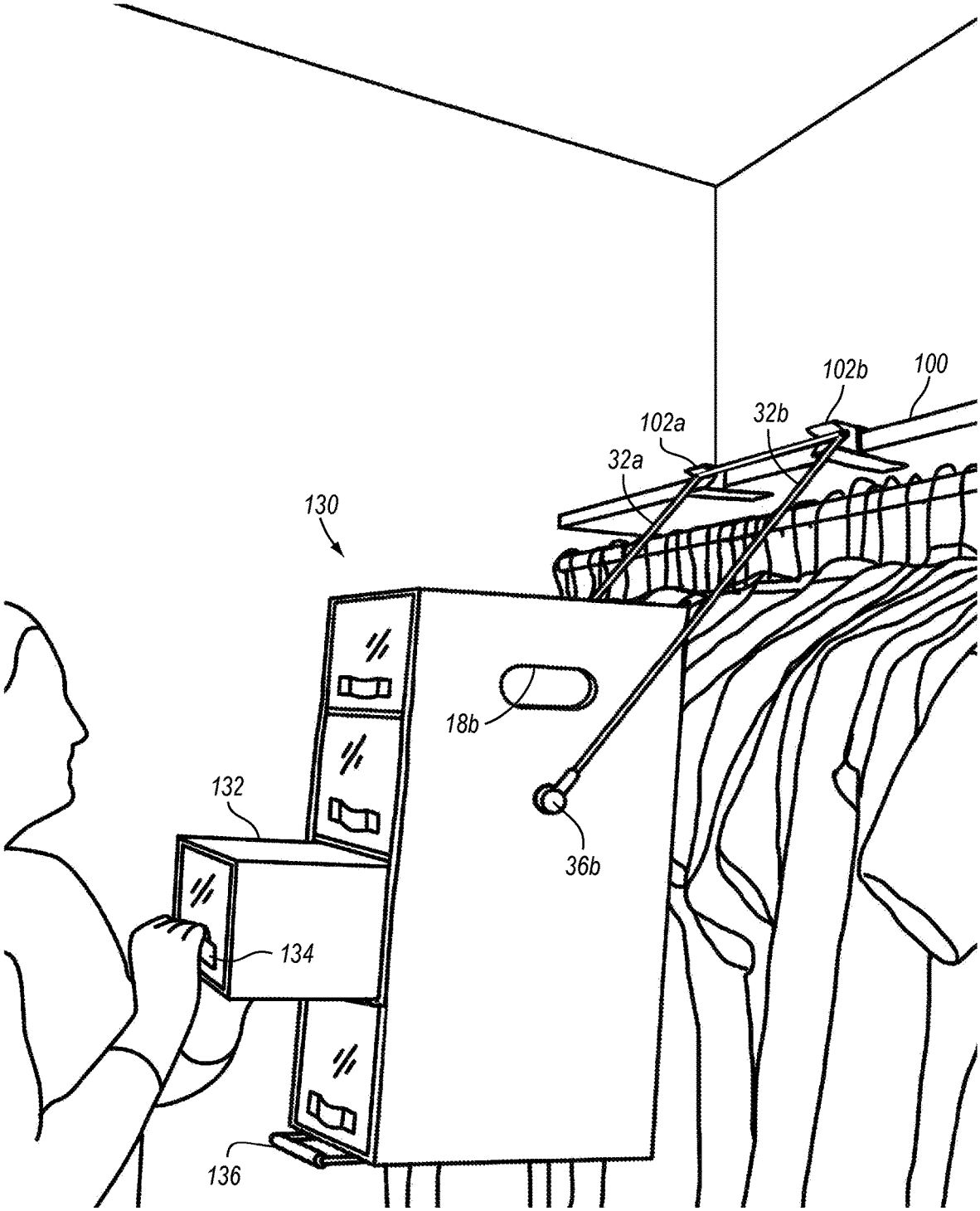
FIG. 16 is a perspective view of a pivotal container having multiple pull-type drawers.

FIG. 16 illustrates another container 130 that can be rotated from a positon in which it can be loaded with items, to a stowed located on or above the shelf 100. The pivoting mechanism otherwise functions in the same manner described above. The container 130 houses multiple drawers, each of which can hold items for storage. In practice, the container 130 can hold about twice the amount of articles as compared to the container 10 described above. The front sidewall of each of the drawers 132 can be constructed of a transparent material. The container 130 is much like a file cabinet, but is light in weight and made of plastic, paperboard or other lightweight material. One drawer is illustrated as numeral 132, which has a handle 134 for withdrawing the drawer 132 from the container 130. The drawers 132 can each be of the same or different sizes. Each drawer compartment in the container 130 has a floor on which it slides in and out of the container 130. The container 130 is constructed with a handle 136 attached to a bottom thereof. The handle 136 can be reached and grasped by the user when the container 130 is swung to its stowed position over the shelf 100.

Figure 17:
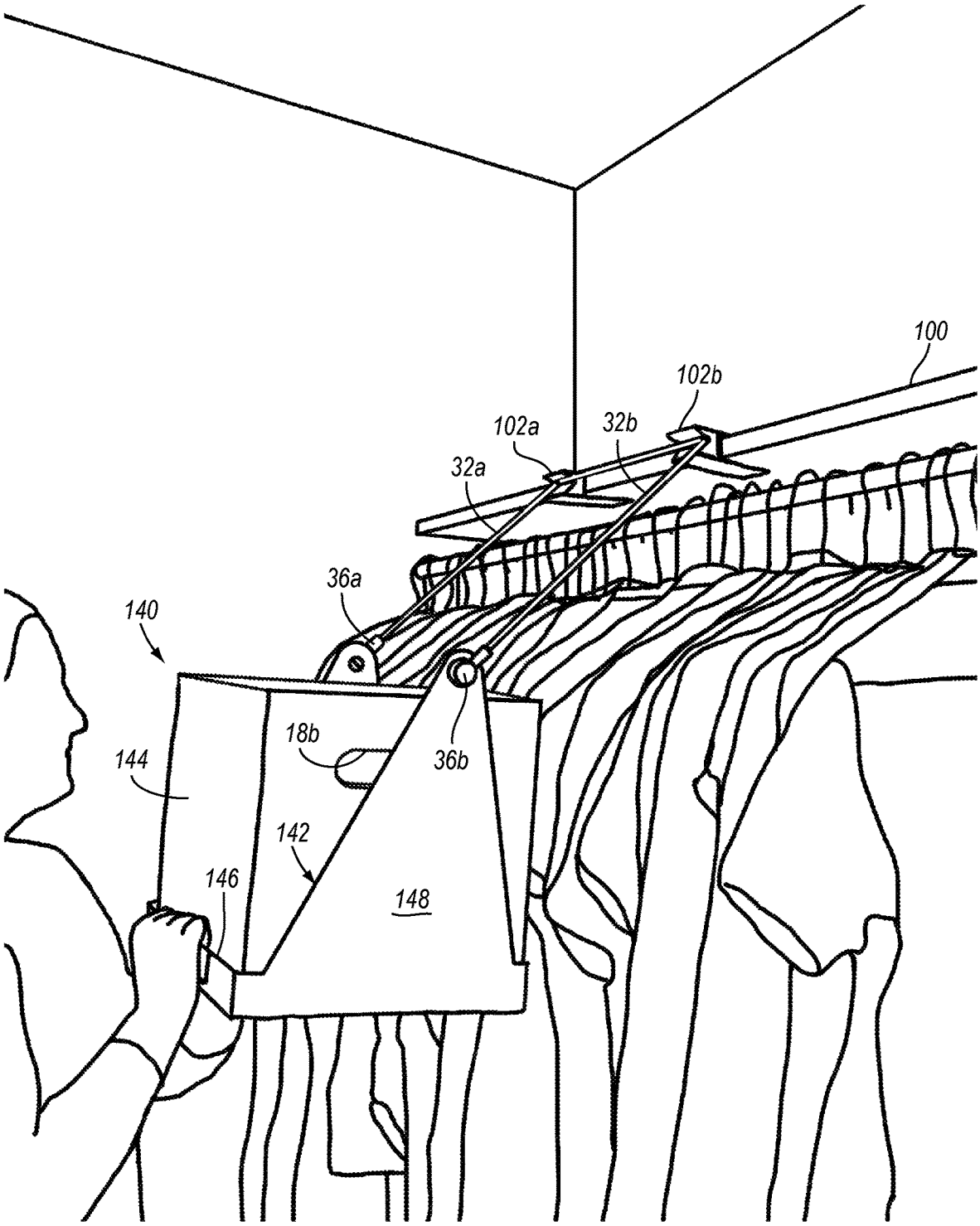
FIG. 17 is a perspective view of a pivotal container arrangement in which a tray is adapted for holding thereon a conventional storage box.

FIG. 17 illustrates yet another container arrangement 140 that can be rotated from a positon in which it can be loaded with items, to a stowed located on or above the shelf 100. The pivoting mechanism otherwise functions in the same manner described above. The container arrangement 140 is characterized by the use of a tray 142 for holding thereon a conventional storage box 144 that is twelve by twelve inches, and twelve inches high. The storage box 144 is illustrated without a top lid. The tray 142 is constructed with a bottom having four upturned flaps that are short in height. One upturned flap is illustrated as numeral 146. Formed integral with two opposite upturned flaps is a respective triangular-shaped side panel 148, the top of each of which is equipped with a grommet (not shown) in which a snap 36*a* and 36*b* is pivotally attached. With this arrangement, the user can load the storage box 144 while the box 144 is lying on the floor, and then transfer the box 144 to the tray 142, whereupon the user can grasp the front upturned flap 146 and swing the container 140 in an arc to a stowed location over the shelf 100.

While numerous containers have been described in detail, those skilled in the art can envision many other types of containers adapted for holding goods, where the containers are equipped with the pivoting mechanisms to allow the containers to be swung in an arc between two different positions. Indeed, the user can utilize all of the container types side by side on a shelf so that the proper storage medium is available.

The storage system of the invention makes it easier to retrieve items stored on or above an overhead shelf. The container is expanded outwardly from a flat shape into a cube shape. In order to maintain the cube shape, a flat rigid panel is inserted in the bottom of the container. The user then attaches the plastic shelf brackets (for a wire shelf) or clips (for a wooden shelf) to the front edge of either a wire shelf or a wooden shelf. The ends of a "U" shaped metal rod are snapped into grommets on opposite sides of the container. The center cross bar part of the "U" shaped metal rod is snapped into the shelf brackets attached to the front edge of the shelf. The ease with which the container and brackets can be installed can be appreciated, as no skill or tools are necessary.

Unlike many of the prior art storage systems, the storage system of the invention container does not move horizontally in a linear path with respect to the shelf, the container can be rotated by the user without rotating the cross bar in an arcuate path, and the storage system requires no slide rails or rollers. The container according to the invention remains in an upright position during its entire pivotal movement about the cross bar, and the container is removable from its pivotal snaps.

In operation, the user moves the container from the stowed position by pulling on the front handle of the container. This rotates the container off the shelf and to a position down below the shelf and in front of the user. The user can conveniently fill the container with items, or remove items therefrom, and then rotate the container upwardly. The pivotal movement of the metal support rod forces the container back on the shelf in a stowed position. An advantage of the invention is that a user never has to reach much higher than the shelf itself to retrieve items stacked high on an overhead shelf.

The various embodiments of the container and associated pivoting mechanisms are not limited to closets, but could be used with shelving in garages and many other areas. The storage system is not limited to the storage of clothing items, but could be utilized to store an inventory of items to be sold in a warehouse, retail store, or the like. In addition, it should be appreciated that, where practical, any feature of any one of the embodiments disclosed herein can be utilized in the other embodiments.

The users of the storage system of the invention can use multiple containers in pantries to organize food items. Wire baskets could be utilized instead of plastic or paper containers. When used in a pantry, the spices can be organized in one basket, cake or cookie mixes another basket, cereal in another basket etc. When used in closet, socks can be organized in one container, t-shirts in another, winter apparel in another, summer apparel in another, etc.

While the preferred and other embodiments of the invention have been disclosed with reference to specific storage system, and associated methods of fabrication thereof, it is to be understood that many changes in detail may be made as a matter of engineering choices without departing from the spirit and scope of the invention, as defined by the appended claims.

What is claimed is:

1. A storage system comprising:

a container for storing items therein, said container having a respective opening formed in opposite sidewalls thereof, a U-shaped support rod having two arms where each said arm terminates in a respective end, each terminal end of said support rod pivotally attached to a respective said sidewall of said container so that said container rotates about its pivotal attachment with said support rod ends, and said U-shaped support rod having a cross bar integral with said two arms, said cross bar constructed with an angle to each said arm, and said cross bar and said two arms constructed with a single rod so as to be integral;

the openings formed in opposite sidewalls of said container having an annular band of material formed around each opening, and each said annular band of material having an opening, and the respective opening in each said annular band of material is smaller in diameter than the corresponding opening in the opposite sidewalls of said container;

a respective snap connected to each terminal end of said support rod arm, each of said snaps pivotally engaging within the opening of a respective said band of material to provide said pivotal attachment, and each said snap having an enlarged end that passes through the respective opening in said band of material to prevent disengagement thereof;

one or more shelf-engaging brackets, each said shelf-engaging bracket having a receptacle that receives therein said support rod cross bar so that said cross bar can rotate within the receptacle of said one or more shelf-engaging brackets, the respective receptacle of said one or more shelf-engaging brackets extending laterally outwardly beyond the one or more shelf-engaging brackets so that the ends of said support arms can rotate to an elevation below said one or more shelf-engaging brackets; and whereby said crossbar rotates within the receptacle of said one or more shelf-engaging brackets about a stationary axial axis that does not move in an arc, and said container which is pivotally attached to the support rod arms can swing in an arc from a stowed position above said one or more shelf-engaging brackets to a loading positon in front of and lower than said shelf-engaging brackets.

2. The storage system of claim 1, wherein said cross bar is removably attached within the receptacles of said one or more shelf-engaging brackets.

3. The storage system of claim 1, wherein said annular band of material comprises a respective grommet fastened within the openings in the opposite sidewalls of said container, and said snaps each pivotally engaging within a respective said grommet.

4. The storage system of claim 1, wherein said container is constructed so as to be foldable into a flat structure.

5. The storage system of claim 1, wherein said container includes at least one transparent sidewall.

6. The storage system of claim 1, wherein each said one or more shelf-engaging brackets is constructed so as to be snap locked to wires of a wire shelf.

7. The storage system of claim 1, wherein each said one or more shelf-engaging brackets includes a lateral notch for engaging a lateral wire of a wire shelf to prevent backward/forward movement of the one or more shelf-engaging brackets with respect to the wire shelf.

8. The storage system of claim 1, wherein each said one or more shelf-engaging brackets includes plural snap-lock members which, when pushed down between wires of a wire shelf, become locked to the wire shelf.

9. The storage system of claim 1, wherein said container includes one or more drawers.

10. A storage system comprising:

a container for storing items therein, said container constructed with a pair of opposite sidewalls, each said opposite sidewall having a hole therein;

a support rod having two arms connected by a cross bar, each said arm terminates in an end;

a snap connected to each said end of said support rod, each said snap including a stud terminating in an enlarged end, the stud rotatable in a respective said container sidewall hole, and the enlarged ends prevents inadvertent removal of said snap from the respective said sidewall hole;

one or more shelf brackets, each said shelf bracket having a receptacle for removably receiving therein said cross bar of said support rod so that said cross bar rotates within the receptacle of said one or more shelf brackets, but said cross bar cannot rotate in an arc, and the arms of said support rod extend from the receptacles of said one or more shelf brackets and swing in an arc during movement of said container;

the cross bar of said support rod is removed from the one or more shelf brackets by pulling thereon so that said container can be carried by a user of said storage system; and whereby said container swings from a stowed position to a loading positon in front of and at a lower elevation than the shelf brackets.

11. The storage system of claim 10, wherein said one or more shelf brackets is constructed so as to be snap locked to wires.

12. The storage system of claim 10, wherein said one or more shelf brackets includes spaced apart members with inner planar surfaces.

13. The storage system of claim 12, further including a friction pad attached to each said planar member.

14. The storage system of claim 10, wherein each said one or more shelf brackets further includes a thumb operated catch/release mechanism for releasing an engagement of said cross bar from the respective said one or more shelf brackets.

15. The storage system of claim 10, wherein said container is collapsible from a cube structure to a flat structure, said container having at least two opposite sidewalls that are each foldable in respective midsections thereof, and including a non-foldable bottom panel.

16. A storage system comprising:

a container constructed so as to be unfolded from a flat structure to a cube structure with four sidewalls, said container including a bottom panel forming a bottom of the container, a frontal panel, and said container having an open top that overlies said bottom panel when said container is in an upright position;

a support rod, said support rod having a lateral cross bar at one end thereof and two arms that each terminate in an end, each said support rod end pivotally attachable to a respective sidewall of opposite sidewalls of said container, whereby when said support rod is pivoted about said lateral cross bar, said container swings about an arc but remain upright;

a shelf-engaging bracket having a receptacle for removably receiving therein the cross bar of said support rod, said receptacle extending laterally outwardly from said shelf-engaging bracket, said cross bar is pushed in the receptacle of said shelf-engaging bracket by a user of the storage system to pivotally attach said container to said shelf-engaging bracket, and said cross bar is pulled from said receptacle of said shelf-engaging bracket by the user to carry said container to a remote location to place contents into said container;

said lateral cross bar of said support rod pivotally rotates within the receptacle of said shelf-engaging bracket but does not move in an arc with said container as said container swings in an arc with the ends of said support rod;

a length of each said arm of said support rod allows said cross bar to be swung in an arc about the pivotal attachment of said support arm ends to said container, so that said cross bar is laterally spaced from the frontal panel of said container; and whereby said container can be moved by a user from a stowed location to a loading location that is lower in elevation than the shelf-engaging bracket.

17. The storage system of claim 16, wherein said container includes a handle attached to the frontal panel of said container.

18. The storage system of claim 16, wherein the lateral cross bar is pivotally fastened to the frontal edge of the shelf without using threaded fasteners.

19. The storage system of claim 16, wherein said container does not move horizontally in a linear path with respect to the shelf-engaging bracket, and the container can be rotated by the user without rotating the cross bar in an arc, and said storage system includes no slide rails or rollers.

* * * * *